US005738460A

United States Patent [19]

Flynn

[11] Patent Number: 5,738,460

[45] Date of Patent: Apr. 14, 1998

[54] BLUEPRINT CARRIER

[76] Inventor: Dallas Edward Flynn, Rte. 4 Box 30 B, Detroit Lakes, Minn. 56501

[21] Appl. No.: 706,724

[22] Filed: Sep. 6, 1996

[51] Int. Cl.[6] ..... B42F 13/00

[52] U.S. Cl. ..... 402/73; 402/70; 402/79; 402/4; 281/29; 281/38

[58] Field of Search ..... 402/79, 37, 4, 402/73; 781/38, 30, 45; 206/287.1; 190/107

[56] References Cited

U.S. PATENT DOCUMENTS

| | | | |
|---|---|---|---|
| 621,824 | 3/1899 | Kleeman | 190/107 |
| 665,256 | 1/1901 | McComb | 281/30 |
| 2,562,518 | 7/1951 | Abrams | 402/37 |
| 2,677,376 | 5/1954 | Brunner | 402/79 |
| 4,334,373 | 6/1982 | Bryan | 40/19 |
| 4,444,418 | 4/1984 | Goldstein | 281/45 |
| 4,824,273 | 4/1989 | Silva et al. | 402/79 |
| 5,028,075 | 7/1991 | Donnelly | 281/49 |
| 5,351,992 | 10/1994 | Chilson et al. | 281/31 |
| 5,407,230 | 4/1995 | Brink et al. | 281/15.1 |

*Primary Examiner*—Willmon Fridie, Jr.
*Attorney, Agent, or Firm*—Curtis V. Harr

[57] ABSTRACT

The present invention discloses a portfolio type device employing sealed plastic sheet protectors fastened together in a ringed binder, and enclosed by a durable outer shell this shell may be made of a suitable material such as leather, vinyl or nylon canvas. When in the closed position, the present invention employs a zipper on three sides to secure the shell, thereby completely encasing the documents and providing protection from wind, rain and other elements. On the fourth side of the device is attached a handle to facilitate portability of said device. The plastic sheet protectors may be of varying sizes to accommodate oversized documents such as blueprints, photographs, business cards or other documents. The oversized sheet protectors may be folded over to fit within the present invention when it in the closed position, although not causing permanent folds or curling of the edges of the document. The ring binder portion of the present invention comprises a single piece, which is held into the outer casing by means of a snap on its outermost ends. When the snaps are disengaged, the ring binder component can be removed and attached to a hanging blueprint rack for display of the enclosed documents.

13 Claims, 4 Drawing Sheets

BLUEPRINT CARRIER

BACKGROUND OF THE INVENTION

The present invention relates to an improvement in the construction of a portfolio-type carrying case for the transportation of blueprints and other oversized documents.

In the past, architects and builders found it necessary to transport essential documents, particularly blueprints or maps, to job sites in order to refer to such documents during the building process. Projects employing the use of such documents are typically lengthy, and it was desirable to keep them in good condition throughout its duration.

A common means for transporting these documents was a tube made of cardboard or similar material. The tubes tended to be bulky and difficult to carry. Additionally, this method required that the document be rolled up before insertion into the tube. Often instead of a tube blueprints were simply rolled and secured with a rubber band. Consequently, when a document was removed from the tube or rubber banded roll, its edges frequently curled, making it hard to manage and difficult to read. A flat surface was usually required to roll out the blueprints in order to read them.

Another problem associated with having blueprints at a job site is the possibility that they may be damaged by wind, rain, dust or dirt. These sensitive documents are also susceptible to fading due to exposure to sunlight. Additionally, notations could not be made on original documents without damage to the original blueprint.

The problems discussed above are not limited to blueprints. Often, other documents are required be kept in new condition and protected from the elements, while at the same time easily accessible. These documents could include photographs, building permits and other reports.

U.S. Pat. No. 4,334,373, Bryan, Jun. 15, 1982, illustrates a combined sheet display holder and rolled sheet holder for use in holding building permits and blueprints. The blueprints are contained in a rolled position in the tube portion of the device, said tube being attachable to the flat sheet display portion of the device. While this device protects blueprints from the elements, it employs the tube-type configuration discussed above, resulting in curled edges and difficult transportation. Additionally, this device does not provide for use with documents other than permits and blueprints, specifically, photographs.

U.S. Pat. No. 5,028,075, Donnelly, Jul. 2, 1991, shows a folded folio for easy transportation of blueprints, which opens to a flat position, providing a surface for displaying documents. While this configuration provides some protection for the blueprints, they still can be damaged by wind, rain or dust when the folio is in the open position. Also, the device in limited in its use with other documents.

U.S. Pat. No. 5,407,230, Brink and Keable, Apr. 18, 1995 shows a print folder, which consists of a foldably connecting front and rear cover with a book-like spine, and a method for securing the front and rear covers when in the folded position. The device is particularly designed for containing and viewing photographs and similar documents, but does not provide for use with oversized documents such as blueprints.

From the foregoing discussion, it can be clearly seen that it would be desirable to provide a method for conveniently transporting and displaying multiple documents, both oversized documents, such as blueprints, and other documents, such as photographs, building permits and reports. More specifically, to provide a method which allows for easy carrying and storage and that does not result in curled edges, folding or other damage to the documents.

Additionally, it would be desirable to provide a method of protecting the documents from the elements. Specifically, to provide protection from wind, rain, dust and dirt normally associated with outdoor projects, and UV rays, which often cause fading. This method would also allow for making temporary notations on the protected document without causing permanent damage.

Further, it would be desirable to provide a device that is adaptable to various types and sizes of documents, as well as various professions and projects. It would also be desirable to provide a device which could be adaptable to existing hanging blueprint racks or blueprint drawers for display of the documents.

SUMMARY OF THE INVENTION

It is the primary objective of the present invention to provide a convenient method of carrying and displaying various sizes of documents. Specifically, to provide for use with oversized documents, such as blueprints, while allowing adaptability for use with smaller documents. The present invention will also provide a means of allowing an individual user to organize projects according to specific needs.

It is a further objective of the present invention to provide a method for protecting such documents when they are being displayed.

It is a further objective of the present invention to provide a method by which the device can be adapted for use with a hanging blueprint rack without requiring removal of the documents from the present invention.

These objectives are accomplished by means of a portfolio type of device employing sealed plastic sheet protectors fastened together in a ringed binder, and enclosed by a durable outer shell made of leather, vinyl, nylon or another suitable material. This outer shell may be supplied with various pockets using a variety of closure methods. When in the closed position, the present invention employs a zipper on three sides to secure the shell, thereby completely encasing the documents and providing protection from wind, rain and other elements. On the fourth side of the device is attached a handle to facilitate portability of said device.

The plastic sheet protectors may be of varying sizes to accommodate oversized documents, photographs, 8½×11" papers, business cards or other sized documents. Typically the sheet protectors are supplied with a zip type locking seal and constructed of an anti-static treated, ultra violet shielding, non-glare plastic. Each protector can hold two documents back-to-back. These protectors shield the enclosed documents from damage while the present invention is in an open position for displaying the documents, specifically from weather and fading. The user can make notations on the plastic protectors with a grease-pencil or other suitable marking means, which is erasable and does not damage the original document. The oversized sheet protectors may be folded over to fit within the present invention when it in the closed position, although not causing permanent folds or curling of the edges of the document.

The ring binder comprises a single piece, which is held into the outer casing by means of a plurality of snaps. When the snaps are disengaged, the ring binder component can be removed and attached to a hanging blueprint rack for display of the enclosed documents or placed flat in a blueprint storage drawer.

For a better understanding of the present invention reference should be made to the drawings in which there is illustrated and described preferred embodiments of the present invention.

DESCRIPTION OF THE PREFERRED EMBODIMENT

Figure 1:
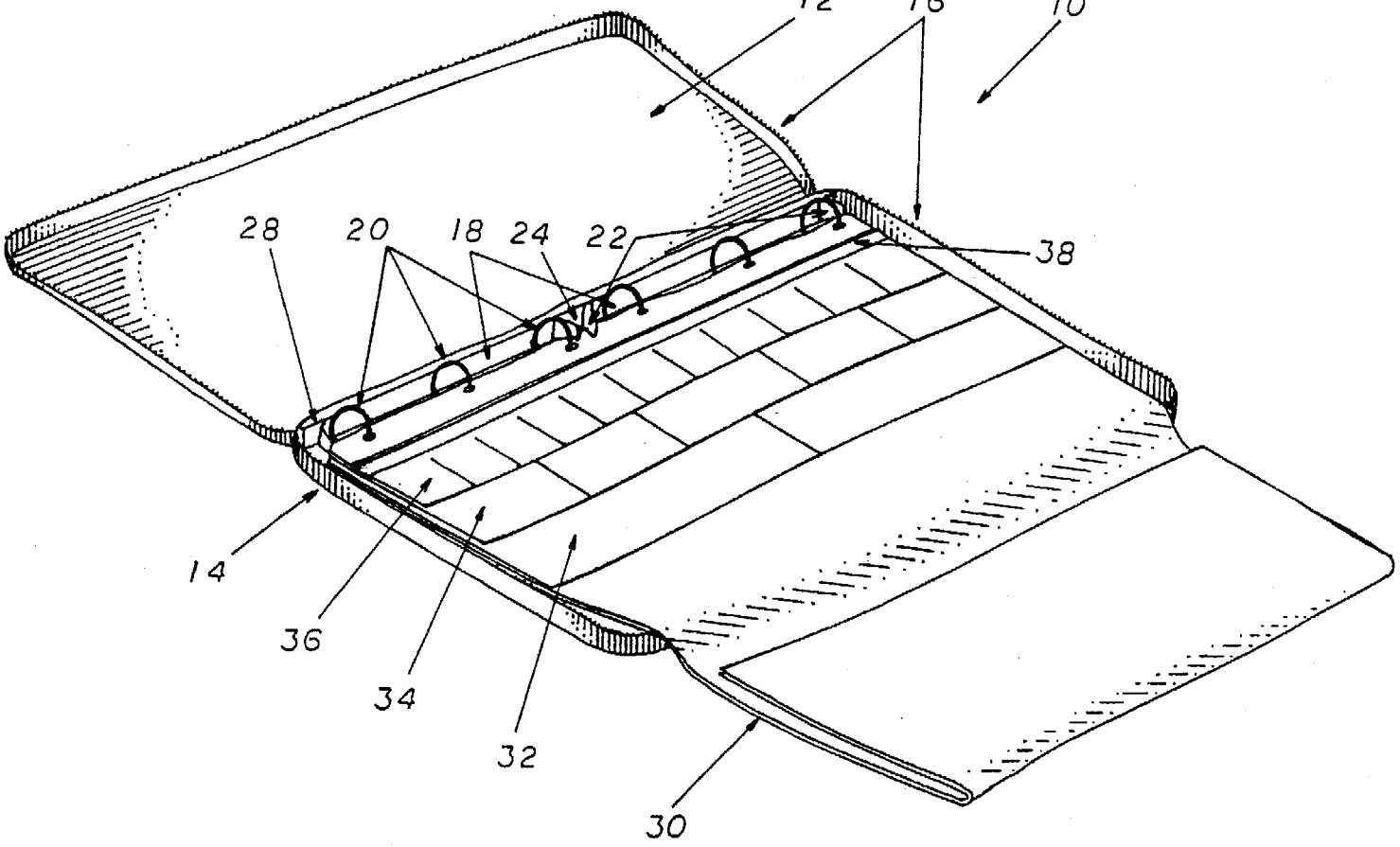
FIG. 1 is a perspective view of the Blueprint Carrier showing the manner in which the major components fit within the zippered outer casing.
Figure 2:
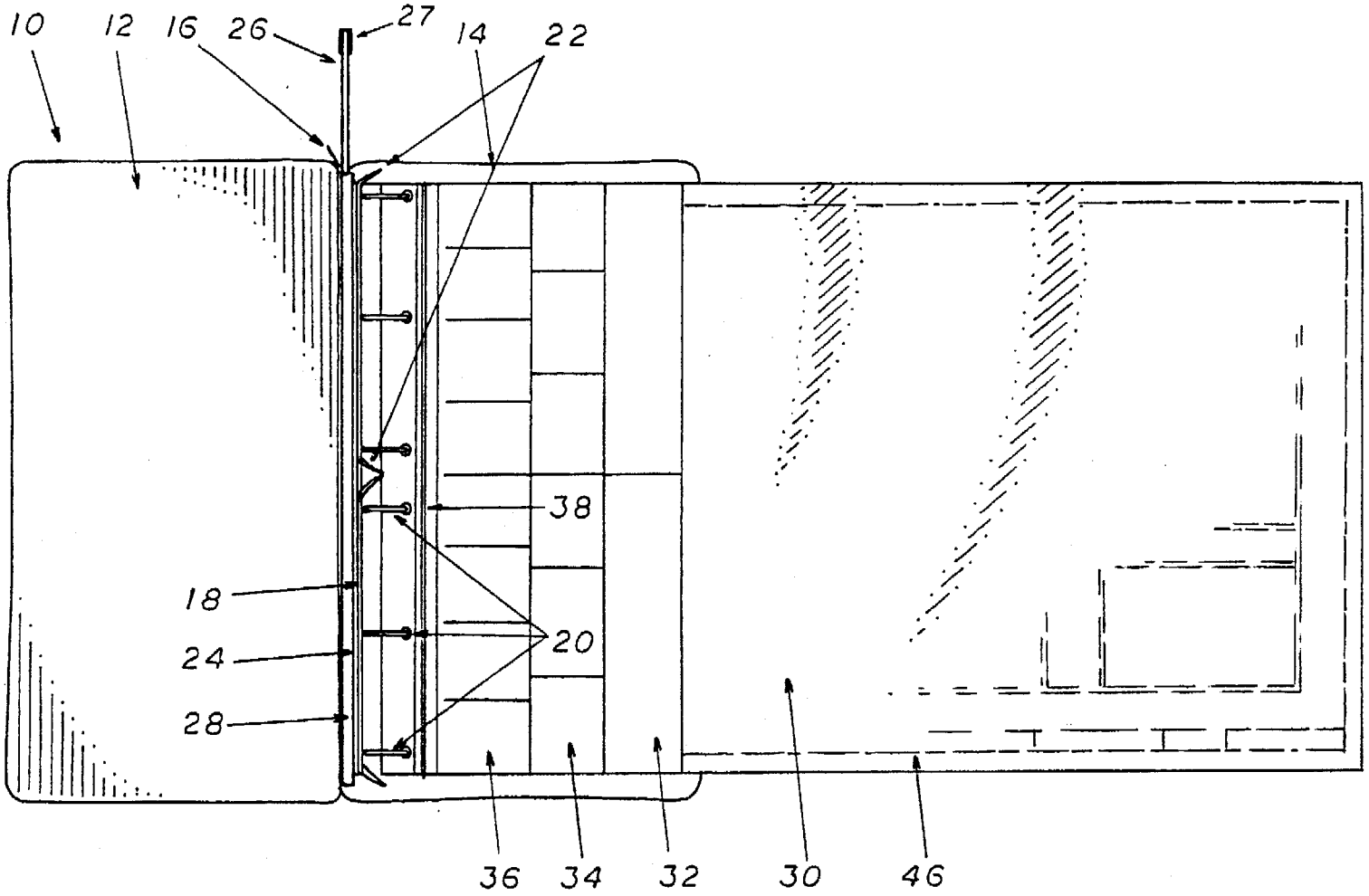
FIG. 2 is a top elevation view of the present invention showing the manner in which the blueprint bags attach to the ridged spine of said invention and how the blueprint insertion rod fits within said spine.

Referring now to the drawings, and more specifically to FIGS. 1 and 2, the Blueprint Carrier 10 comprises an upper case 12 and a lower case 14 which are rectangular in shape and are permanently fixed together along their most forward edge. At this point it should be noted that the upper and lower case may be fitted with a variety of storage pockets as deemed necessary. The remaining three edges of the upper and lower cases, 12 and 14, are equipped with the corresponding halves of the case zipper 16. When the halves of the case zipper 16 are engaged to one another it forms an open cavity within the upper and lower cases, 12 and 14 thus protecting the contents of the Blueprint Carrier 10. Alternatively, when the halves of the case zipper 16 are disengaged from one another it allows for the upper and lower cases, 12 and 14, to be opened, thus allowing for the access to the cavity.

Located within the cavity form by the upper and lower cases, 12 and 14, and along their permanently fixed edge is the insertion stick retaining bag 28 which functions as a storage place for the insertion stick 26. This configuration also operates as a solid attachment point for the rigid spine 24. The rigid spine 24 provides the attachment point for the binder backing 18, which in turn functions as the attachment point for the two sets of binder rings 20.

The binder rings 20 provide the method of installing and retaining the blueprint plastic zipper bag 30. This is accomplished by opening the binder rings 20 by use of the binder ring release tabs 22. The size of the blueprint 46 will usually determine the size of blueprint carrier 10 which will in turn determine the number of binder rings 20 supplied. When the binder rings 20 are opened, one may either insert into or remove a blueprint plastic zipper bag 30 from the Blueprint Carrier 10 as needed. Additionally, varying designs of plastic zippered bags, such as the letter-size document plastic zipper bag 32, the photo plastic zipper bag 34, or the business card plastic zipper bag 36 are available to accommodate various sizes of documents, thus increasing the versatility and usefulness of the Blueprint carrier 10. Each of the plastic zipper bags is equipped with a plastic bag zipper seal 38, which forms a moisture and dust proof seal, which, when closed, protect the documents contained therein.

Figure 3:
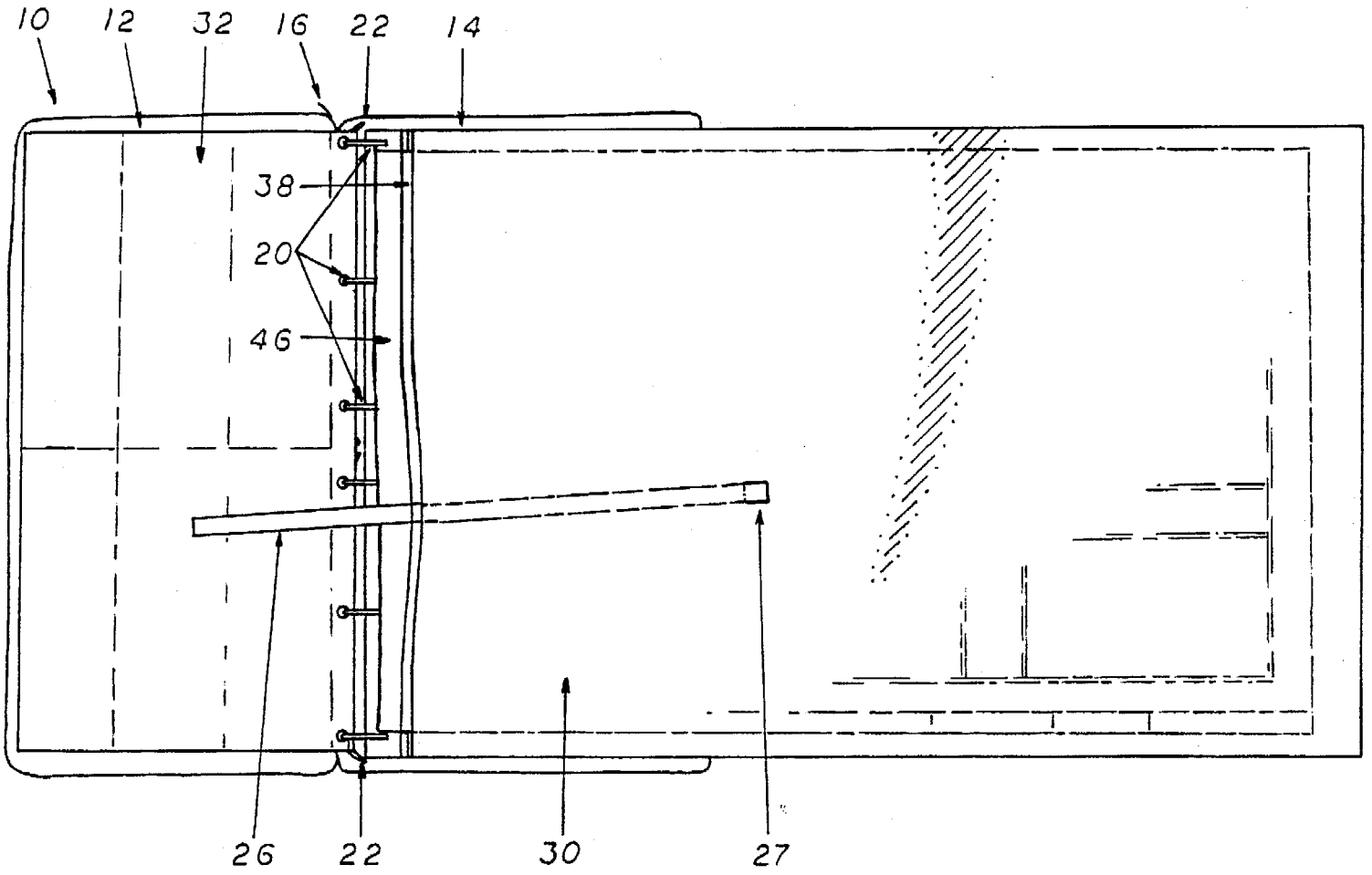
FIG. 3 is a top elevation view of the present invention showing how the blueprint insertion rod is employed to aid in placing a blueprint into the blueprint bag.

FIG. 3 depicts the manner in which the insertion stick 26 is used to feed a large document, such as a blueprint 46, into a blueprint plastic zipper bag 30. This is accomplished by opening the plastic bag zipper seal 38 and slowly sliding the blueprint 46 into the blueprint plastic zipper bag 30. The insertion stick 26 is used to push the blueprint 46 completely into the blueprint plastic zipper bag 30. The blueprint insertion is aided by a plastic coated end 27 on the insertion stick 26. This plastic coated insertion stick end 27 helps to grip and protect the blueprint or oversized document 46 during the insertion process. This allows for the insertion, as shown, of a delicate blueprint 46 into the full length of the blueprint plastic zipper bag 30 without causing damage such as creases, folds or tears.

Figure 4:
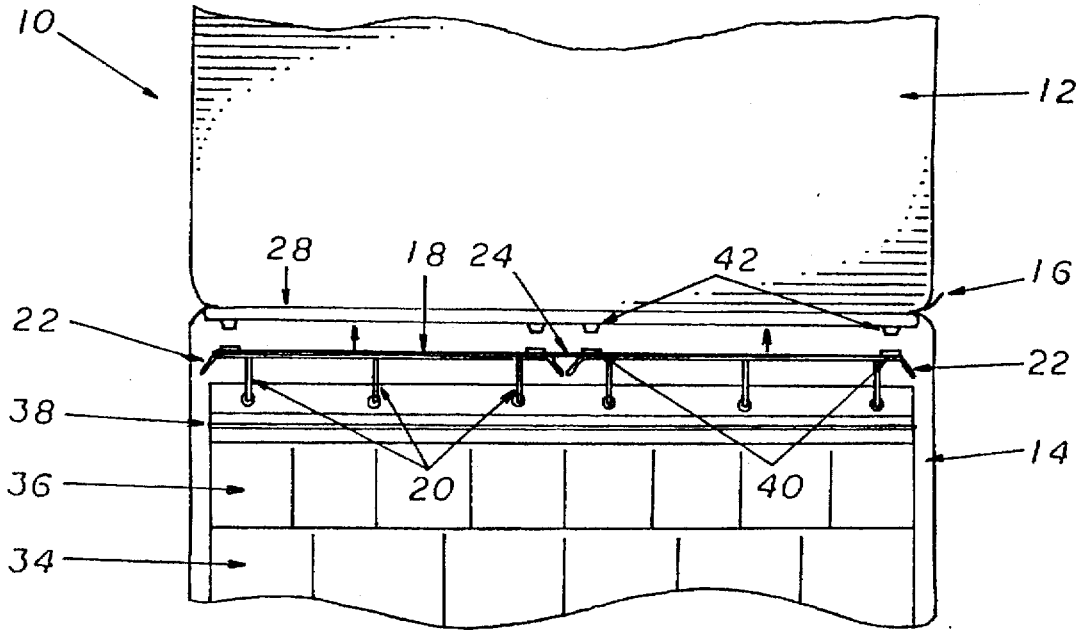
FIG. 4 is a top elevation view of the present invention showing the way the binder backing, and therefore the blueprint bags, are easily removable from the ridged spine of said invention.

One important feature of the Blueprint Carrier 10 is that its design allows for the removal of the rigid spine 24 from the body of the present invention as shown by FIG. 4. This is accomplished by the means of having female snap members 40 located on the most forward surface of the rigid spine 24 and the corresponding male snap members 42, located on the most rearward surface of the insertion stick retaining bag 28. This configuration allows for the removal of the blueprint plastic zipper bag 30, and thereby the blueprint 46 itself, from the Blueprint Carrier 10, without requiring the blueprints 46 removal from the sealed protection provided by the blueprint plastic zipper bag 30. Once separated from the Blueprint Carrier 10, the rigid spine 24 provides a means by which the encased blueprint 46 may be stored in a hanging position on a rack (not shown) when not being used for the transportation of documents.

Figure 5:
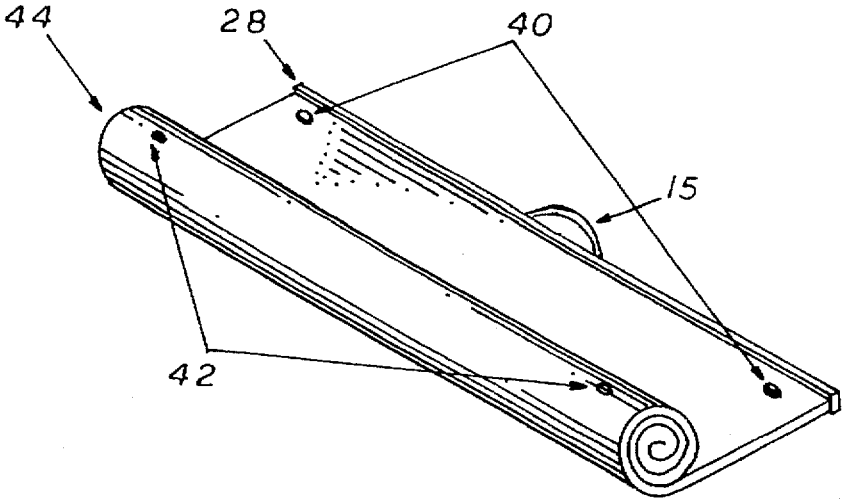
FIG. 5 is a perspective view of the present invention showing an alternative embodiment in which the outer casing is without the zippered sides which allows the present invention to be rolled up and snapped together thereby protecting the valuable blueprints or documents contained therein.

FIG. 5 illustrates an alternative embodiment of the present invention in which the case zipper 16 is not employed. Instead, the Rollable Blueprint Carrier 44 forms a protective covering over the blueprint plastic zipper bags 30 that may be rolled up for transport or when not in use. This embodiment employs the use of the female snap members 40 and the male snap members on the outside surface of the present invention which snap together to hold it in the rolled up position. It is important to note that the size of the Rollable Blueprint Carrier 44 will determine the number of snaps used and that these snaps could be replaced with other suitable means such as hook and loop fasteners. The Rollable Blueprint Carrier 44 is further supplied with a insertion stick retaining bag 28 This provides the rigid edge by which the present invention may be hung on a rack when not in use. FIG. 5 further illustrates the placement of a typical carrying handle 15 which may be employed on the various embodiments of the present invention.

Although the present invention has been described in considerable detail with reference to certain preferred versions thereof, other versions are possible. For example the case may be supplied in a variety of sizes including cases large enough to accommodate the zipper bags without folding. Other variations may include the use of fasteners such as hook and loop in place of snaps. The carrier may also employ other features such as a shoulder strap. Therefore, the spirit and scope of the appended claims should not be limited to the description of the preferred versions contained herein.

What is claimed is:

1. A document carrying case comprising:

A book style case having an upper and lower case side so as to be positioned one above the other with each respective side having a top edge;

A flat rigid document insertion stick substantially the length of said top edge;

A connecting portion about the top edge of each of said upper and lower case forming a four sided center spine connecting portion said spine connecting portion further forming a pocket having at least one open side for removably receiving said document insertion stick;

A rigid spine portion having a plurality of openable binder rings fixedly attached to said rigid spine portion;

A means of opening said binder rings; and

A means of removably attaching said rigid spine portion to said spine connecting portion attachment means.

2. A document carrying case as in claim 1 wherein said rigid document insertion stick is supplied with a plastic coated end.

3. A document carrying case as in claim 2 wherein said case further comprises removable plastic pages supplied with a watertight zipper seal.

4. A document carrying case as in claim 3 wherein said means of removably attaching said rigid spine portion to said center spine connecting portion is a plurality of button snaps.

5. A document and blueprint carrying case comprising:

A book style case having an upper and lower case side so as to be positioned one above the other with each respective side having a top edge, a bottom edge and a right and left side edge;

A flat rigid document insertion stick substantially the length of said top edge;

A connecting portion about the top edge of each of said upper and lower case forming a four sided center spine connecting portion said spine connecting portion further forming a pocket having at least one open side for removably receiving said document insertion stick;

A zipper connecting said right left and bottom edge of said upper and lower case;

A rigid spine portion having a plurality of openable binder rings fixedly attached to said rigid spline portion;

A means of opening said binder rings; and

A means of removably attaching said rigid spine portion to said spine connecting portion attachment means.

6. A document carrying case as in claim 5 wherein said rigid document insertion stick is supplied with a plastic coated end.

7. A document carrying case as in claim 6 wherein said case further comprises removable plastic pages supplied with a watertight zipper seal.

8. A document carrying case as in claim 7 wherein said means of removably attaching said rigid spine portion to said spine connecting portion is a plurality button snaps.

9. A rollable document and blueprint carrying case comprising:

A book style case having an upper and lower case side so as to be positioned one above the other with each respective side having a top edge, a bottom edge and a right and left side edge;

A flat rigid document insertion stick substantially the length of said top edge;

A connecting portion about the top edge of each of said upper and lower case forming a four sided center spine connecting portion said spine connecting portion further forming a pocket having at least one open side for removably receiving said document insertion stick;

A first fastening means about the upper case adjacent to said top edge and a second fastening means for attaching to said first fastening means about the lower case adjacent to said bottom edge, with said first and second fastening means making it possible to roll said case and fasten it into a rolled position;

A rigid spine portion having a plurality of openable binder rings fixedly attached to said rigid spine portion;

A means of opening said binder rings; and

A means of removably attaching said rigid spine portion to said spine connecting portion attachment means.

10. A document carrying case as in claim 9 wherein said rigid document insertion stick is supplied with a plastic coated end.

11. A document carrying case as in claim 10 wherein said case further comprises removable plastic pages supplied with a watertight zipper seal.

12. A document carrying case as in claim 11 wherein said means of removably attaching said rigid spine portion to said spine connecting portion is a plurality button snaps.

13. A document carrying case as in claim 12 wherein said first and second fastening means comprises button snaps.

* * * * *